US005469027A

United States Patent [19]

Uchihashi et al.

[11] Patent Number: 5,469,027

[45] Date of Patent: Nov. 21, 1995

[54] DEVICE FOR OPERATING A HIGH PRESSURE GAS DISCHARGE LAMP

[75] Inventors: Kiyoaki Uchihashi; Hiroshi Nishimura, both of Kobe; Noriyuki Fukumori, Neyagawa, all of Japan

[73] Assignee: Matsushita Electric Works, Ltd., Kadoma, Japan

[21] Appl. No.: 321,824

[22] Filed: Oct. 6, 1994

[30] Foreign Application Priority Data

Jun. 28, 1994 [JP] Japan ..... 6-146796

[51] Int. Cl.[6] ..... H05B 37/02

[52] U.S. Cl. ..... 315/224; 315/307; 315/DIG. 7; 315/247; 315/291

[58] Field of Search ..... 315/248, 307, 315/308, 291, 247, 205, 248, 224, DIG. 7

*Primary Examiner*—Benny Lee
*Assistant Examiner*—Michael Shingleton
*Attorney, Agent, or Firm*—Armstrong, Westerman, Hattori, McLeland & Naughton

[57] ABSTRACT

A device for operating a high pressure gas discharge lamp with an electronic ballast having a lamp power factor of substantially 1.0. The device utilizes a lamp equi-luminescence performance curve X which is obtained for the lamp to give a lamp voltage and a lamp wattage that can vary along the curve X while keeping an arc luminescence of an arc developing between electrodes of the lamp at substantially constant level. The arc luminescence is defined as a maximum luminescence of the arc having varying luminescence along the length of the arc. The constant level determined to be the luminescence that the lamp gives at the rated lamp voltage. The curve X is analyzed to determine a specific lamp voltage Va at which curve X gives a maximum lamp wattage Wa. The lamp is operated in accordance with a first load characteristic for controlling to increase the lamp wattage substantially along the lamp performance curve X until the lamp voltage increases to the specific lamp voltage Va. After the lamp voltage increases beyond the specific lamp voltage Va, the lamp is operated in accordance with a second load characteristic for controlling to keep the lamp wattage above the lamp performance curve X but not exceeding the maximum lamp wattage Wa as well as to keep the arc luminescence below a predetermined limit level.

7 Claims, 9 Drawing Sheets

FIG. 1
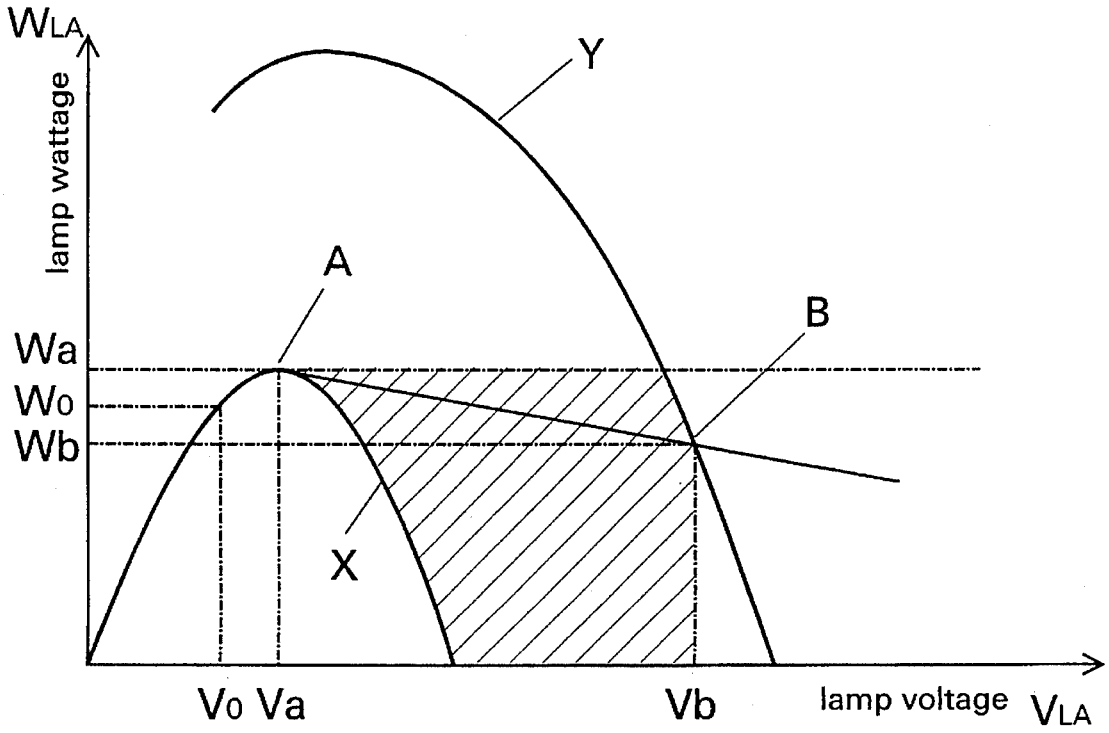
FIG. 4A
FIG. 4B
FIG. 4C
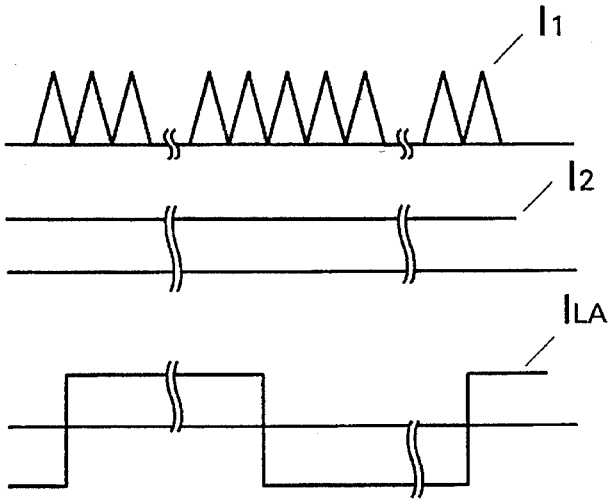

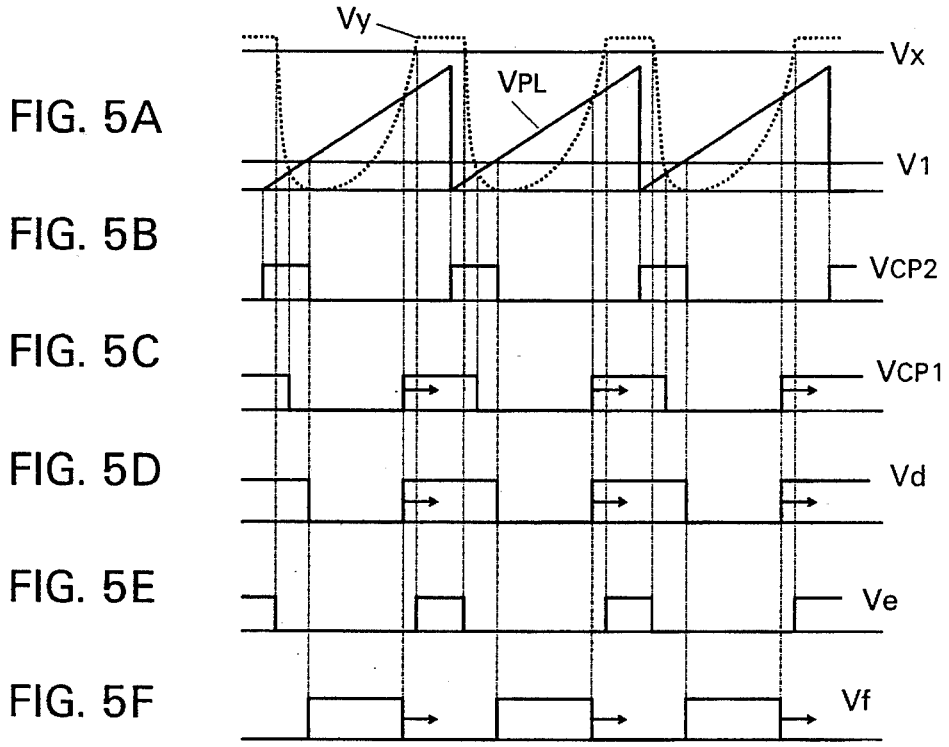
FIG. 5A
FIG. 5B
FIG. 5C
FIG. 5D
FIG. 5E
FIG. 5F
Vy
VPL
Vx
V1
VCP2
VCP1
Vd
Ve
Vf
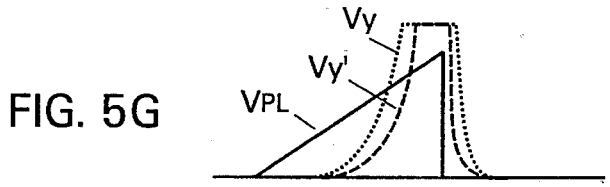
FIG. 5G
Vy
Vy'
VPL
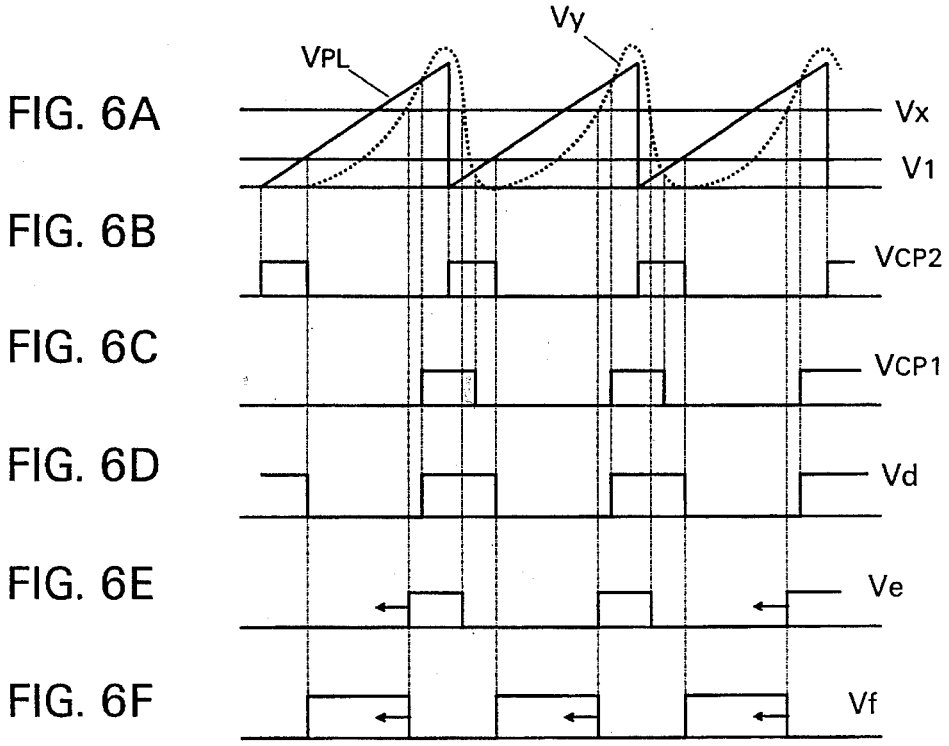
FIG. 6A
FIG. 6B
FIG. 6C
FIG. 6D
FIG. 6E
FIG. 6F
VPL
Vy
Vx
V1
VCP2
VCP1
Vd
Ve
Vf FIG. 8A
FIG. 8B
FIG. 8C
FIG. 8D
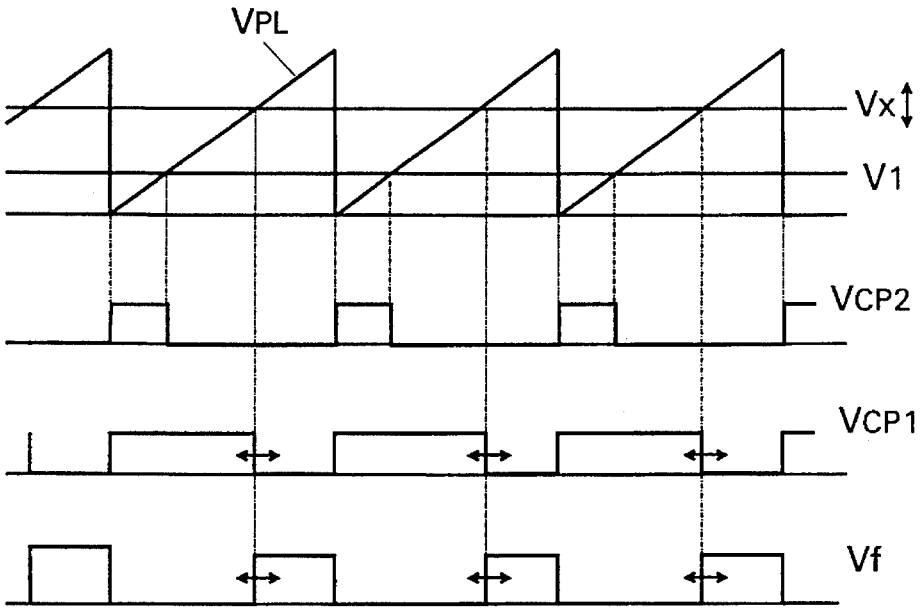
FIG. 10A
FIG. 10B
FIG. 10C
FIG. 10D
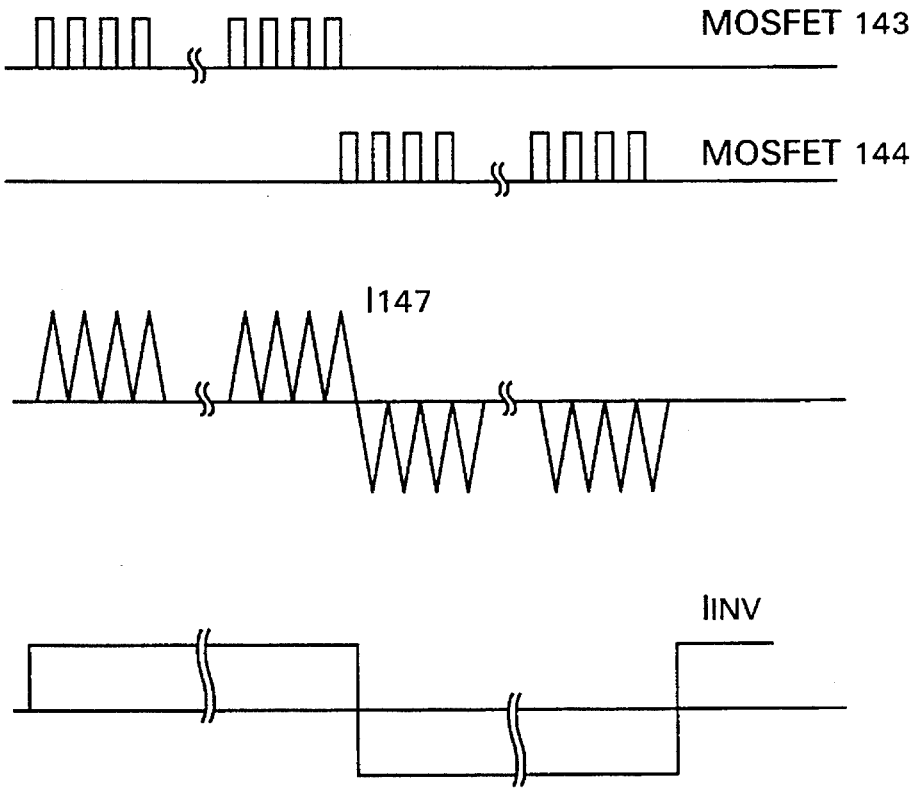

DEVICE FOR OPERATING A HIGH PRESSURE GAS DISCHARGE LAMP

BACKGROUND OF THE INVENTION

1. Field of the Invention

The present invention is directed to a device for operating a high pressure gas discharge lamp with the use of an electronic ballast having an improved lamp factor of substantially 1.0.

2. Description of the Prior Art

Electronic ballasts are expected to operate a high pressure gas discharge lamp for the reason that it can be made compact and lightweight as compared to a conventional so-called inductive ballast. In addition, the electronic ballast is known to be advantageous over the conventional inductive ballast in that the electronic ballast having a lamp power factor of substantially 1.0 requires less lamp voltage and lamp current for obtaining a rated operating wattage than the conventional ballast having lamp power factor of 0.9 or less, as is apparent from graphs of FIGS. 12A and 12B in which load characteristics of the lamp operated by the electronic ballast is designated by solid lines, while load characteristics of the lamp operated by the conventional ballast is designated by dotted lines. FIG. 12A shows the respective load characteristics with the lamp wattage $W_{LA}$ on the axis of ordinate and the lamp voltage $V_{LA}$ on the axis of abscissa. FIG. 12B shows the same load characteristics with the lamp voltage $V_{LA}$ on the axis of ordinate and the lamp current $I_{LA}$ on the axis of abscissa. As seen from the figures, the lamp operated by the electronic ballast requires less rated lamp voltage $V_{01}$ and current $I_{01}$ for producing rated lamp wattage $W_0$ than rated lamp voltage $V_{02}$ and current $I_{02}$ for the lamp operated by the conventional ballast. In this respect, the electronic ballast is assumed to cause less temperature stress to the lamp than the conventional ballast. Also with regard to a maximum lamp wattage applied to the lamp, the electronic ballast gives a less maximum lamp wattage because of less lamp voltage and current than the conventional ballast, and is therefore assumed to lower the temperature stress. In this consequence, the electronic ballast is expected to extend lamp operating life.

Nevertheless, the electronic ballast is found to give only reduced lamp operating life. In fact, some lamps operated by the electronic ballast are found to have a reduced lamp operating life as less as one-half of that operated by the conventional ballast. Through investigations, the inventors have revealed that a local temperature rise occurs more significantly in an arc tube of the lamp when operated by the electronic ballast than by the conventional ballast. The investigations were focused on an arc luminescence as representative of the local temperature of the lamp. The arc luminescence was measured by operating the horizontally placed lamp, as shown in FIG. 13, and defined as a maximum luminescence at a point X of an arc developed between electrodes 2 of the lamp to have varying luminescence along the length of the arc, and is acknowledged to be in a generally direct proportion to the local temperature of the lamp. The investigation was carried out to measure points of equal arc luminescence by varying lamp wattage $W_{LA}$ and voltages $V_{LA}$ respectively with the use of the electronic ballast and the conventional ballast for three lamps, i.e., new one, old one just reaching end of the lamp life and exhibiting a maximum lamp voltage, and an intermediate one. The lamps utilized are 150W metal halide lamps sold under the name of HQI-TS 150W/NDL by OSRAM, Germany. Three levels of arc luminescence were selected for each lamp in order to obtain the equi-luminescence points 1, 2, and 3 of different levels with correspondingly differing lamp wattage and voltage, the arc luminescence level becomes greater in this order (3>2>1). Thus measured points were plotted, as shown in FIG. 13, to give lines $N_{EW1}$ and $N_{EW2}$, $I_{NT1}$ and $I_{NT2}$, and $O_{LD1}$ and $O_{LD2}$ for the new, intermediate, old lamps operated respectively by the electronic ballast and the conventional ballast, in which the solid lines and dotted lines denote the varying arc luminescence of the lamp operated, respectively by the electronic ballast and the conventional ballast. From FIG. 13, it is known that so far as the lamp voltage $V_{LA}$ is around the rated voltage $V_{01}$, no substantial difference is seen between the lamp wattage required at the electronic ballast and the conventional ballast to give the same arc luminescence. But, after the lamp voltage increasing further beyond the rated voltage $V_{01}$ as a result of the lamp having experienced a long period use, considerable differences are seen between the lamp wattage required to give the same arc luminescence of the levels 2 and 3, respectively. In other words, as the lamp voltage increases further beyond the rated lamp voltage, it is seen that, when the same lamps are operated by the electronic ballast and the conventional ballast to give the same lamp wattage, i.e., illumination level, the lamp operated by the electronic ballast shows the arc luminescence which is significantly greater than the lamp operated by the conventional ballast. This means that the electronic ballast brings about a significant local temperature rise in the lamp as compared to the conventional ballast when operating the lamp at the same lamp wattage. Such significant local temperature rise is thought attributable to the improved lamp power factor that the electronic ballast gives. That is, the electronic ballast requires less lamp current than the conventional ballast in order to give the same lamp wattage, and gives narrower arc than the conventional ballast when effecting the same average arc temperature. Consequently, it is assumed that, as the lamp voltage exceeds the rated voltage, the lamp current concentrates in the center of the arc to thereby remarkably increase the arc luminescence, or the maximum luminescence at the center of the arc. As the arc luminescence becomes greater with attendant local temperature rise in the lamp, the arc tube made of silica glass is exposed at its center to local heat concentration. When such local heat concentration becomes significant, the silica glass undergoes recrystallization to result a whitely turbid portion. Thus whitely turbid portion is thought to reflect light and heat from the arc on the other portion of the tube to thereby raise the overall temperature of the tube, which eventually deteriorates the lamp to such a level not capable of operating any further. As for the lamp filled with sodium, the local or overall temperature rise of the arc tube is thought to bring about leakage of sodium, thereby critically deteriorating the lamp.

In order to avoid the above problem for extending the lamp operating life, the inventors have proposed in the Japanese patent publication (KOKOKU) No. 576158 a method of operating the high pressure gas discharge lamp with the use of the electronic ballast having a lamp power factor of about 1.0. The method is characterized to vary the lamp wattage in accordance with a lamp equi-luminescence characteristic curve so as to keep arc luminescence of the arc at a constant level over the varying lamp voltage. The equi-luminescence characteristic curve is analogous to three solid line curves $X_1$, $X_2$, and $X_3$ which are given in FIG. 13 by exploration of equal luminescence points, but is selected to represent the arc luminescence level which is equal to that produced at the rated lamp voltage. With this method, it is possible to eliminate undue increase in the arc luminescence, i.e., local temperature rise as the lamp is operated at the increasing lamp voltage beyond the rated lamp voltage, thereby extending the lamp operation life.

Although the above method is effective to extend the lamp life, it poses another problem that the lamp wattage is lowered sharply with attendance lowering of luminous flux when the lamp voltage increases beyond the rated voltage, as seen from the characteristic curves $X_1$, $X_2$, and $X_3$ in FIG. 13.

SUMMARY OF THE INVENTION

The above problems have been eliminated in the present invention which provides a device for operating a high pressure gas discharge lamp to extend the lamp life as well as to keep consistent lamp wattage throughout the expected lamp life. The device utilizes an electronic ballast having a lamp power factor of substantially 1.0 to operate the lamp which has a rated lamp voltage and exhibits an increasing lamp voltage throughout expected lamp life. Reference is made to FIG. 1 for easy comprehension of the present invention. The device relies on a step of obtaining a lamp equi-luminescence performance curve X along which a lamp voltage $V_{LA}$ and a lamp wattage $W_{LA}$ vary in such a manner as to keep arc luminescence of an arc developing between electrodes of the lamp at substantially constant level. The arc luminescence is defined to be a maximum luminescence of the arc having varying luminescence along the length of the arc. The above constant level is determined to be the luminescence that the lamp gives when operated by the electronic ballast at the rated lamp voltage $V_{01}$. Thus obtained lamp performance curve X is analyzed to determine a specific lamp voltage at which the performance curve shows a point of inflection having a maximum lamp wattage Wa. The device comprises means for realizing the steps of operating the lamp in accordance with a first load characteristic for controlling to increase the lamp wattage $W_{LA}$ substantially along the lamp performance curve X until the lamp voltage $V_{LA}$ increases to the specific lamp voltage Va; and operating the lamp, after the lamp voltage increases beyond the specific lamp voltage Va, in accordance with a second load characteristic for controlling to keep the lamp wattage above the lamp performance curve X but not exceeding the maximum lamp wattage Wa as well as to keep the arc luminescence below a predetermined limit level. Accordingly, it is a primary object of the present invention to provide a device of operating the high pressure gas discharge lamp which is capable of extending the lamp operating life, yet without lowering the luminous flux of the lamp.

The maximum lamp wattage Wa is provided to give an upper limit of the operable lamp wattage below which the lamp can be operated over an extended lamp life without practically lowering the luminous flux for the reason discussed below. Through further study of the lamp performance curve X, the inventors experimentally found that the lamp life is shortened if the lamp wattage increases beyond the maximum lamp wattage Wa as the lamp voltage increases beyond the specific lamp voltage Va. That is, as the lamp voltage increases, the arc will bend by a greater extent to thereby comes closer to the wall of the arc tube and therefore bring about local temperature rise of the tube with the attendant increasing lamp current, i.e., lamp wattage. This effect of raising the local temperature was found critical to damage the lamp when the lamp voltage increases beyond the specific lamp voltage Va with otherwise attendant increase of the lamp wattage beyond the maximum lamp wattage Wa. Upon this finding, the second load characteristic is determined to have the upper limit of the lamp wattage which is equal to the maximum lamp wattage Wa on the equi-luminescence performance curve at the specific lamp voltage Va in order to avoid damaging the lamp and therefore ensure an extended operation lamp life.

Also the upper limit of the arc luminescence is determined to operate the lamp safely below a maximum allowable lamp temperature provided by a lamp manufacturer. Generally, the lamp manufacturer provides the maximum allowable lamp temperature in terms of an allowable maximum lamp wattage which is determined on a basis of operating the lamp by the conventional ballast having a lamp power factor of about 0.9. Therefore, no problem occurs when operating the lamp within the specified allowable maximum lamp wattage. However, when using the electronic ballast having a lamp power factor of substantially 1.0, the lamp may be overheated to exceed the allowable maximum temperature to thereby damage the lamp, even if the lamp wattage is below the specified allowable maximum lamp wattage. In consideration of the above possibility, the present invention gives the upper limit of the arc luminescence which is well indicative of the lamp temperature in order to eliminate overheating of the lamp and therefore ensure the extended lamp life in compensation for the difference in the power factor between the electronic ballast and the conventional ballast. The upper limit of the arc luminescence is determined to be an arc luminescence which the lamp operated by the conventional ballast gives just before the end of the lamp life, i.e., at the maximum operable lamp voltage Vb.

Preferably, the second load characteristic is represented by a line which has a negative gradient of the lamp wattage with respect to the increasing lamp voltage and which extends from a point of the maximum lamp wattage Wa at the specific lamp voltage Va to a point B of the lamp wattage at an operating voltage on another lamp performance curve Y. The operating voltage is required to operate a near-end-of-life discharge lamp by a conventional so-called inductive ballast having the lamp power factor of 0.9 or below. The near-end-of-life discharge lamp is defined to exhibit such a high lamp voltage as to tends to cause extinction when operated by the conventional inductive ballast. The lamp performance Y is obtained to give a varying lamp wattage with respect to the lamp voltage by operating the electronic ballast while maintaining a fixed arc luminescence that the near-end-of-life lamp shows at the operating voltage when operated by the conventional ballast. In accordance with thus determined second load characteristic line, consistent control of the lamp wattage is made to ensure an extended lamp life as well as produce sufficient light output. In this connection, when operating the lamp at or below the lamp wattage B corresponding to the maximum allowable lamp voltage Vb, the lamp is expected to have an extended lamp life greater or at least equal to that operated by the conventional ballast.

The electronic ballast is preferably made to limit lamp wattage when the lamp voltage increases up to the maximum operable lamp voltage Vc so as to forcibly distinguish the lamp at the end of the lamp life, whereby preventing accidental breakage of the lamp which would otherwise occur if the lamp should be operated at a higher lamp wattage even after the lamp voltage increases beyond the maximum operable lamp voltage.

Likewise, the electronic ballast may provides the second load characteristic which gives no effective lamp wattage once the lamp voltage increases beyond the maximum operable lamp voltage as indicative of that the lamp has experienced its entire lamp life, thereby forcibly distinguishing the lamp after the elapse of the lamp life.

The electronic ballast may comprise an inverter which provides a high frequency AC voltage to operate the lamp and include means for realizing the first and second load characteristics, or an inverter which provides an AC voltage of rectangular waveform to operate the lamp and include means for realizing the first and second load characteristics.

These and still other objects and advantageous features of the present invention will become more apparent from the following description of the preferred embodiments when taken in conjunction with the attached drawings.

BRIEF DESCRIPTION OF THE DRAWINGS

FIG. 1 is graph of lamp wattage versus lamp voltage illustrating first and second load characteristic for a high pressure gas discharge lamp achieved in the present invention, which are determined by equi-luminescence performance curve X and Y obtained for the lamp to indicate individual arc luminescence, one that the lamp shows at a rated voltage, and the other that the lamp at the end of lamp life gives, respectively;

FIGS. 4A to 4B are waveform charts illustrating waveforms of currents flowing at points in the circuit of FIG. 2;

FIGS. 5A to 5G are waveform charts illustrating waveforms of voltage at points in the circuit of FIG. 3 when operating the lamp at a lamp voltage below a specific lamp voltage Va;

FIGS. 6A to 6F are waveform charts illustrating waveforms of voltage at the points in the circuit of FIG. 3 when operating the lamp at the lamp voltage above the specific lamp voltage Va;

FIGS. 8A to 8D are waveform charts illustrating the operation of the circuit of FIG. 7;

FIGS. 10A to 10D are waveform charts illustrating the operation of the circuit of FIG. 9;

DETAILED DESCRIPTION OF THE EMBODIMENTS

Figure 14:
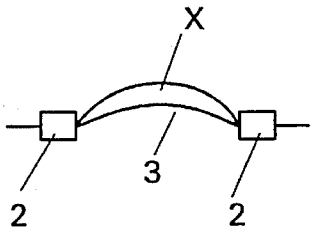
FIG. 14 is a schematic view of an arc developing between electrodes of an arc tube of the lamp.

Reference is firstly made to FIG. 1, there are shown first and second lamp characteristics in accordance with which a high pressure discharge lamp is operated with the use of an electronic ballast by varying lamp wattage $W_{LA}$ with an increasing lamp voltage $V_{LA}$ over an expected lamp life. The first and second characteristics are determined by two equi-luminescence curves X and Y each obtained for a standard lamp to give points of the same arc luminescence with varying lamp wattage. The arc luminescence is defined as a maximum luminescence of an arc developing between electrodes of an arc tube of the standard lamp when operated by the electronic ballast with the lamp placed horizontally. As shown in FIG. 14, the maximum luminescence is seen at midpoint X of the arc 3 developing between electrodes 2 and having varying luminescence along the length of the arc, and is indicative of a local temperature of the arc tube. The standard lamp utilized is a 150 W metal halide lamp "HQI-TS150W/NDL" available from OSRAM, Germany. The electronic ballast utilized has a lamp power factor of substantially 1.0 and gives a rated lamp voltage $V_0$ for producing a rated lamp wattage $W_0$. The rated lamp voltage $V_0$ is less than rated lamp voltage that is specified by the lamp manufacture for the use of a conventional so-called inductive ballast relying upon a current-limiting transformer and having a lamp power factor of about 0.9 or below. The equi-luminescence curve X indicates points of arc luminescence which is equal to the arc luminescence that the lamp shows at the rated lamp voltage $V_0$ and is obtained by varying load impedance of the lamp with varying lamp wattage. The other equi-luminescence curve Y indicates points of arc luminescence which is equal to arc luminescence that the lamp just reaching the end of its operation life, i.e., having a maximum operable lamp voltage Vb gives when operated by the conventional ballast, and is obtained by varying load impedance of the lamp and lamp wattage. Therefore, the arc luminescence becomes greater at points towards the curve Y from the curve X. The equi-luminescence curve X has a point of inflection at a specific voltage Va which gives a maximum lamp wattage Wa. The first load characteristic along which the lamp is operated is defined by a segment of the equi-luminescence curve X reaching to the maximum lamp wattage Wa given at the specific lamp voltage Va just above the rated voltage $V_0$. The second load characteristic is defined to extend through a cross-hatched region Z from the point of the maximum lamp wattage Wa at the specific lamp voltage Va as the lamp voltage increases further from the specific lamp voltage Va to the maximum operable lamp voltage Vb. The region Z is defined above the curve X from and has an upper limit of the maximum lamp wattage Wa.

Figure 2:
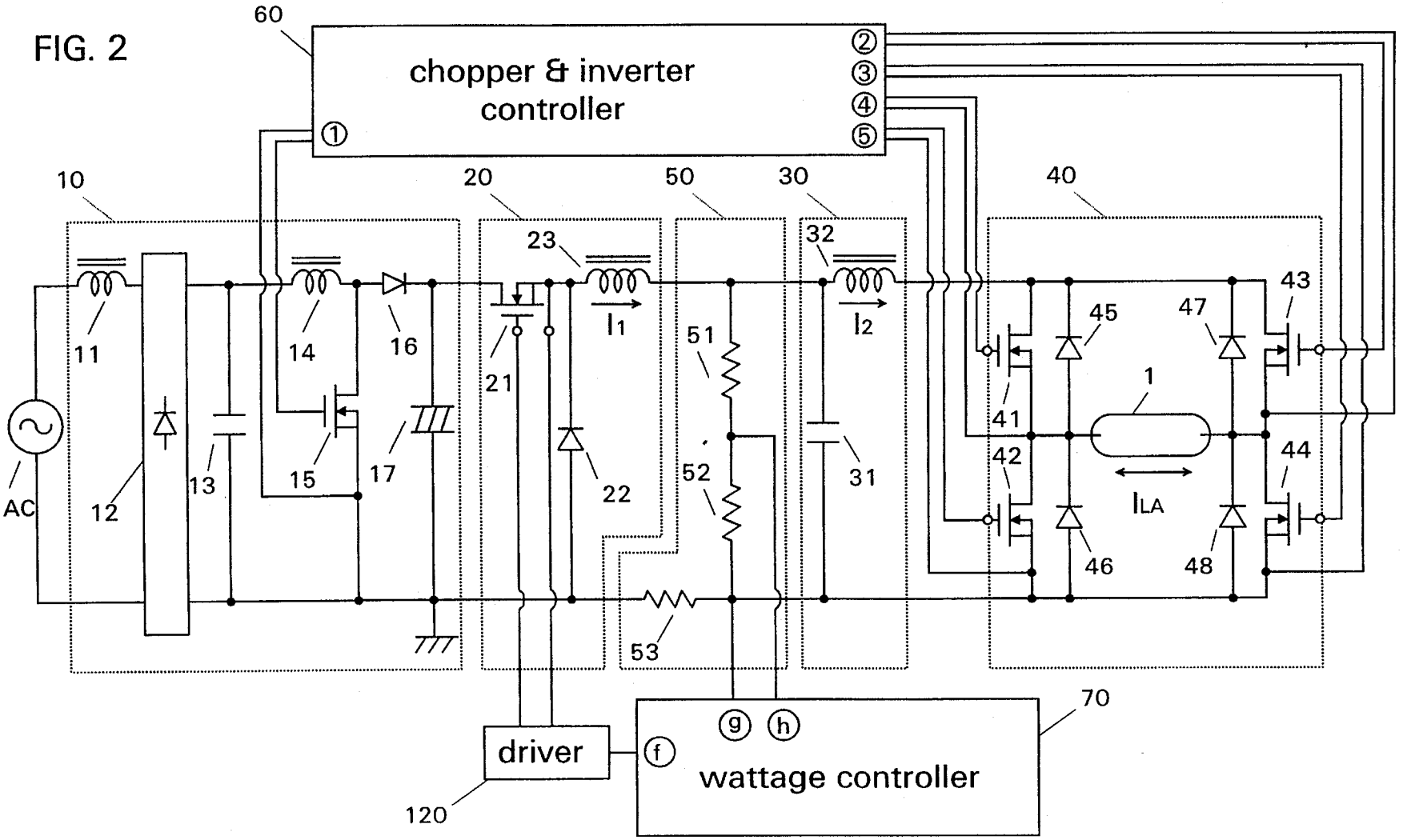
FIG. 2 is a circuit diagram of an electronic ballast utilized for operating the lamp in accordance with a first embodiment of the present invention.

In accordance with a first embodiment of the present invention, the above first and second load characteristics are realized by an electronic ballast having a circuit arrangement of FIG. 2. The electronic ballast comprises a step-up chopper 10 adapted to be connected to an AC voltage source AC to provide therefrom a smoothed step-up DC voltage which is then lowered through a step-down chopper 20 to give a resulting DC voltage through a filter 30 to an inverter 40. The inverter provides an AC voltage from the input DC voltage to operate the lamp 1. A voltage/current detector 50 is inserted between the step-down chopper 20 and the filter 30 to give a divided voltage of the input DC voltage to the inverter 40 as indicative of lamp voltage $V_{LA}$, as well as to give a voltage indicative of the lamp current $I_{LA}$.

The step-up chopper 10 comprises an inductor 11, a diode-bridge rectifier 12, a capacitor 13, an inductor 14, a MOSFET 15, a diode 16, and a smoothing capacitor 17. MOSFET 15 is driven by a chopper $\epsilon_t$ inverter controller 60 to repetitively switch, i.e., chop the pulsating DC voltage from the rectifier 12 at a frequency of 40 to 50 kHz for developing the step-up DC voltage across smoothing capacitor 17. The step-down chopper comprises a MOSFET 21, a diode 22, and an inductor 23. MOSFET 21 is driven by a wattage controller 70 to chop the step-up voltage at a high frequency of 20 to 60 KHz with a varying duty ratio so as to provide a varying step-down DC voltage for supplying through inductor 23 a current $I_1$ of a triangular waveform as shown in FIG. 4A. The current $I_1$ is then removed of a high frequency component by the filter 30 composed of a capacitor 31 and an inductor 32 to give a smoothed DC current $I_2$ to the inverter 40.

The inverter 40 comprises two series connected pairs of MOSFETs 41 to 44 arranged in a full-bridge configuration and four diodes 45 to 48 each connected in anti-parallel relation to each MOSFET. The MOSFET bridge has its input connected to receive the current $I_2$ through the filter 30 and has its output connected to the lamp 1. MOSFETs are driven by the chopper $\epsilon_t$ inverter controller 60 in such a manner as to simultaneously turn on and off one diagonally opposed pair of first and fourth MOSFETs 41 and 44, while turning off and on the other pair of second and third MOSFETs 42 and 43 to give the lamp current $I_{LA}$ of rectangular waveform having a low frequency of 60 to 400 Hz, as shown in FIG. 4C, for operating the lamp 1. The voltage/current detector 50 comprises a voltage divider of resistors 51 and 52 connected across the input of the inverter 40 to provide a voltage signal indicative of the lamp voltage $V_{LA}$. Also included in the is a current sensing resistor 53 which monitors the lamp current $I_{LA}$ and gives a corresponding voltage signal. These voltage signals are fed to terminals (h) and (g) of the wattage controller 70 which responds to vary the duty ratio of MOSFET 21 of the step-down chopper 20 in a feedback manner as discussed below.

Figure 3:
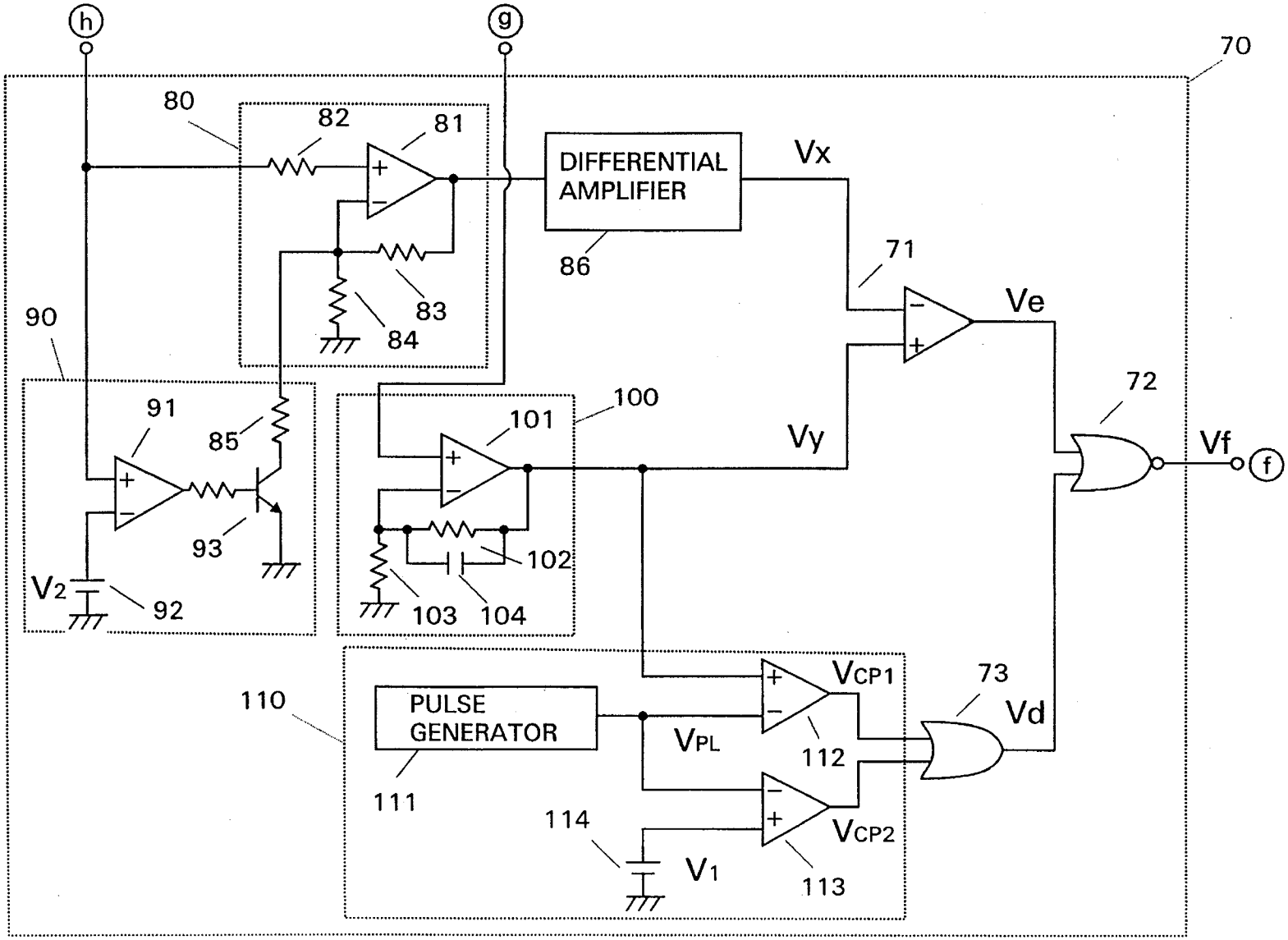
FIG. 3 is a circuit diagram of a wattage controller utilized in the electronic ballast.

As shown in FIG. 3, the wattage controller 70 comprises a lamp voltage amplifier 80, a lamp voltage discriminator 90, a lamp current amplifier 100, and a pulse width modulator 110. The lamp voltage amplifier 80 comprises an operational amplifier 81 which is connected to receive through a resistor 82 the divided voltage indicative of the lamp voltage from the terminal (h) and amplifies the lamp voltage by means of resistors 83, 84, and 85 to give a resulting output voltage to a differential amplifier 86. The differential amplifier 86 gives a varying voltage Vx which becomes greater as the output voltage of operational amplifier 81 becomes smaller. The lamp voltage discriminator 90 comprises a comparator 91 which has its non-inverting input connected to receive from the terminal (h) the same voltage indicative of the lamp voltage and has its inverting input connected to receive a reference voltage $V_2$ from a voltage source 92. The reference voltage $V_2$ is selected to correspond the specific lamp voltage Va (indicated in FIG. 1) so that comparator 91 gives a high level output when the lamp voltage exceeds the specific lamp voltage Va. Upon this occurrence, a transistor 93 is turned on to connect resistor 85 in parallel with resistor 84, thereby raising amplification factor of operational amplifier 81 and therefore lowering voltage Vx from the differential amplifier 86. The lamp current amplifier 100 comprises an operational amplifier 101 which is connected to receive from the terminal (g) the voltage indicative of the lamp current for amplification thereof by means of resistors 102, 103, and capacitor 104. The resulting output Vy is fed to a comparator 71 and is compared thereat with voltage Vx from differential amplifier 86 so that comparator 71 provides an output voltage Ve, as shown in FIGS. 5E and 6E, which is high when voltage Vy from lamp current amplifier 100 is greater than voltage Vx from lamp voltage amplifier 80. The output of comparator 71 is fed to a NOR gate 72. The pulse width modulator (PWM) 110 comprises a pulse generator 111 providing a sawtooth pulse $V_{PL}$, as shown in FIGS. 5A and 6A, commonly to inverting inputs of first and second comparators 112 and 113. First comparator 112 compares voltage Vy from lamp current amplifier 100 with the sawtooth pulse $V_{PL}$ from pulse generator 111 to provide a resulting output $V_{CP1}$, as shown in FIGS. 5C and 6C, to an OR gate 73, while second comparator 113 compares voltage $V_{PL}$ with a reference voltage $V_1$ given from a voltage source 114 to provide a resulting output $V_{CP2}$, as shown in FIGS. 5B and 6B, to OR gate 73. OR gate 73 responds to provide a resulting voltage Vd, as shown in FIGS. 5D and 6D, to NOR gate 72 which in turn provides a control voltage Vf of varying duty ratio, as shown in FIGS. 5F and 6F. The control voltage Vf is fed through a driver 120 so as to turn on MOSFET 21 of step-down chopper 20 for varying ON-period, whereby regulating the lamp current $I_{LA}$ and therefore control lamp wattage $W_{LA}$ in accordance with the detected lamp voltage and lamp current acknowledged by the wattage controller 70.

Operation of controlling lamp wattage is now discussed with reference to FIGS. 5A to 5F and FIGS. 6A to 6F. When the lamp wattage $V_{LA}$ is below the specific voltage Va, transistor 93 is kept turned off so that amplifier 81 acts at a low amplification factor to give a relatively high voltage Vx, as shown in FIG. 5A, which will decrease as the lamp voltage increases towards the specific voltage Va. Voltage Vx is compared with voltage Vy to give voltage Ve, as shown in FIGS. 5E, which is high only when Vx<Vy. At the same time, voltage Vy is compared at first comparator 112 of PWM 110 with sawtooth pulse $V_{PL}$ to give voltage $V_{CP1}$, as shown in FIG. 5C, of which high level period is shortened as lamp voltage increases. This is because that, as the lamp voltage increases to give a correspondingly increasing impedance connected to the output of the step-down chopper 20, voltage Vy representing the current $I_1$ supplied from step-down chopper to the inverter 40 will experience a slackened rising slope, as indicated by Vy' in FIG. 5G, thereby shortening a duration in which Vy exceeds the level of sawtooth pulse $V_{PL}$. The resulting voltage $V_{CP1}$ is gated at OR gate 73 with voltage $V_{CP2}$ of fixed high level duration to give voltage Vd, as shown in FIGS. 5B to 5D. Subsequently, voltage Vd is gated at NOR gate 72 with voltage Ve to give voltage Vf of which high level duration determines ON-period, i.e., duty ratio of MOSFET 21. In this manner, as the lamp voltage $V_{LA}$ increases towards the specific voltage Va, voltage $V_{CP1}$ goes "high" later to thereby shorten the high level duration of voltage Vd, which in turn elongate the high level duration of voltage Vf, as indicated by arrows in the figures. Whereby the lamp current is caused to increase with attendant increase in lamp wattage $W_{LA}$ in accordance with the above defined first characteristic, as shown in FIG. 1. In this connection, the amplification factor of lamp voltage amplifier 80 and lamp current amplifier 90 are chosen in order to vary voltage Vy more critically than voltage Vx as the lamp voltage increases toward the specific lamp voltage Va, such that Vy is substantially alone responsible for varying the duty ratio of MOSFET 21 to control the lamp wattage $W_{LA}$. It is noted that reference voltage $V_1$ is selected to give output voltage $V_{CP2}$ of fixed duty for limiting on-duty of MOSFET 21 to protect MOSFET 21 from receiving undesired excess stress.

When the lamp voltage $V_{LA}$ further increases beyond the specific lamp voltage Va through the lamp life, lamp voltage discriminator 90 responds to turn on transistor 93 so that operational amplifier 80 operates at a high amplification factor to provide a further amplified lamp voltage which in turn reduces the output voltage Vx of differential amplifier 81. FIGS. 6A to 6F illustrate waveforms of voltages Vx, Vy, $V_{CP2}$, $V_{CP1}$, Vd, Ve, and Vd when lamp voltage exceeds the specific lamp voltage Va. In this condition, voltage Vx is lowered as the lamp voltage increases in the direction of elongating high level duration of Ve and therefore shortening high level duration of Vf, i.e., lowering on-duty of MOSFET 21, as indicated by arrows in the figures. While on the other hand, voltage Vy indicative of current $I_1$ supplied to inverter 40 will experience a further slackened rising slope, which tends to shorten the high level duration (Vy>Vx) of voltage Ve and in turn elongate the high level duration of voltage Vf in the direction of raising on-duty of MOSFET 21, as opposed to the effect of lowering voltage Vx. In this respect, the high amplification factor at which operational amplifier 81 operates is selected at a level such that the lowering effect of Vx is predominant over the effect of slackened rising slope of Vy. Thus, as the lamp voltage increases beyond the specific voltage Va, MOSFET 21 is controlled to operate on a decreasing duty ratio to thereby limit the lamp current, i.e., lamp wattage in accordance with the above described second load characteristic, as shown in FIG. 1, in which the lamp wattage $W_{LA}$ is controlled not to exceed the maximum lamp wattage Wa. By suitably selecting amplification factors for amplifiers 80 and 100 it is possible to minimize or even reduce the duty ratio of MOSFET 21 to zero when the lamp voltage increases to maximum operable lamp voltage Vb, in order to correspondingly minimize the lamp wattage to thereby cease operating the lamp once the lamp voltage reaches the lamp voltage Vb. For example, voltage Vx may be lowered to such a level that Vy>Vx is satisfied always to give no high level duration of voltage Vf when lamp voltage reaches the maximum operable lamp voltage Vb.

Figure 7:
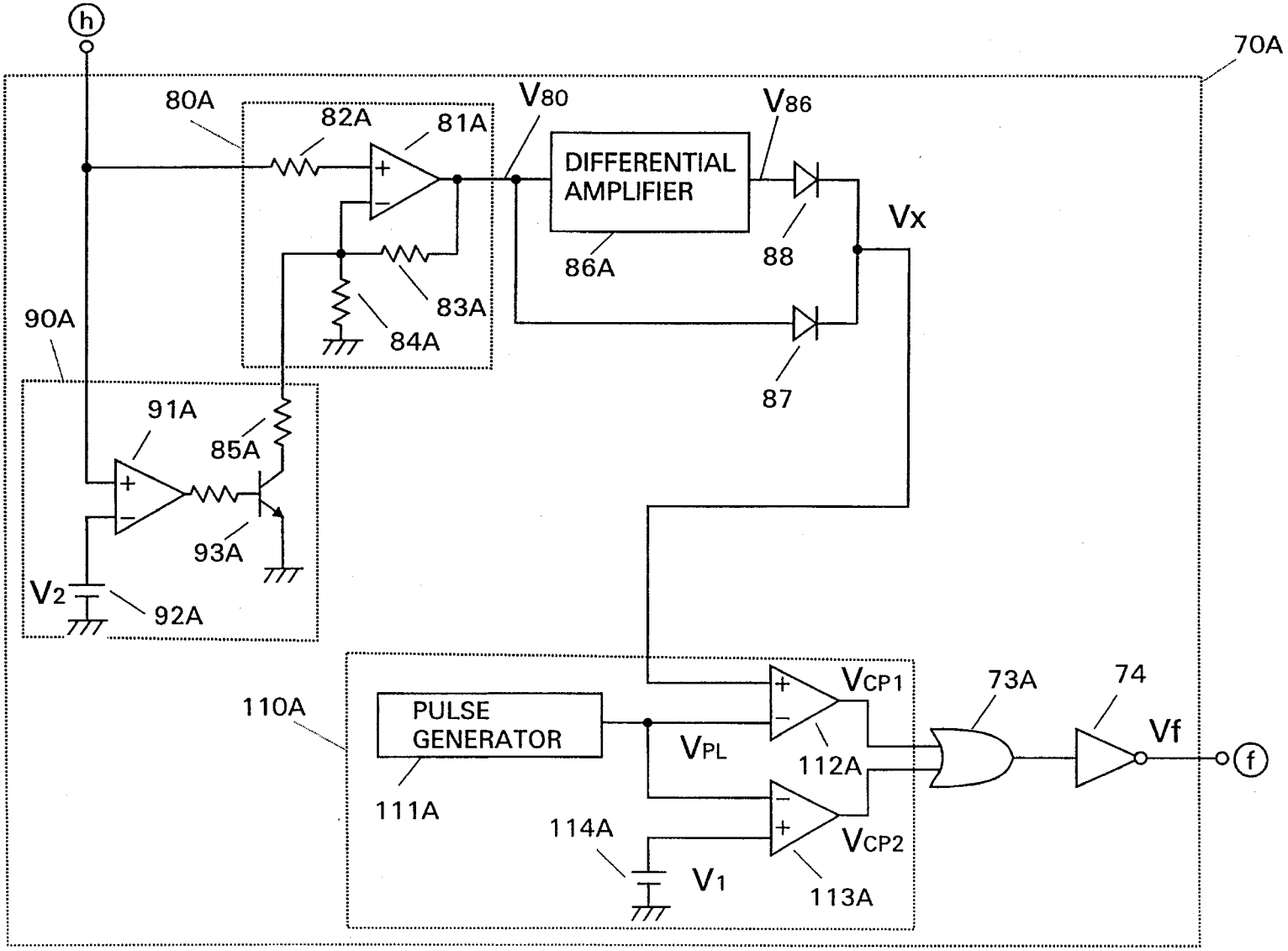
FIG. 7 is a circuit diagram of an electronic ballast utilized for operating the lamp in accordance with a second embodiment of the present invention.

Second Embodiment <FIGS. 7 and 8>

An electronic ballast in accordance with a second embodiment of the present invention has a circuit configuration which is basically identical to the circuit of FIG. 2, but utilizes a wattage controller 70A different from the circuit of FIG. 3. The wattage controller 70A analyzes the lamp voltage provided as a divided voltage from the detector 50 to control MOSFET 21 in a feedback manner. As shown in FIG. 7, the wattage controller 70A comprises a lamp voltage amplifier 80A, a lamp voltage discriminator 90A, and a pulse width modulator 110A which are of the same circuit configuration as utilized in the circuit of FIG. 3, but are differently arranged therefrom. Like components are designated by like numerals with a suffix letter of "A". Output $V_{80}$ of operational amplifier 81A and output $V_{86}$ of differential amplifier 86A are fed through respective diodes 87 and 88 to provide a common output voltage Vx which is equal to the output of either of amplifiers 81A or 86A whichever is greater. In this embodiment, amplification factors of operational amplifier 81A and differential amplifier 86A are selected such that voltage $V_{86}$ is greater than voltage $V_{80}$ when the detected lamp voltage $V_{LA}$ is below the specific lamp voltage Va, and voltage $V_{80}$ is greater than voltage $V_{86}$ when the detected lamp voltage $V_{LA}$ exceeds the specific lamp voltage Va. Accordingly, voltage Vx is defined by voltage $V_{86}$ until the lamp voltage increases to voltage Va, and is defined by voltage $V_{80}$ after the lamp voltage increases beyond voltage Va. Lamp voltage discriminator 92A is configured to change amplification factor from low to high when the detected lamp voltage reaches to the maximum allowable lamp voltage Vb as indicative of the lamp being deteriorated to its end of the lamp life. That is, reference voltage V2 of lamp voltage discriminator 92B is selected to correspond to voltage Vb, as opposed to the first embodiment in which reference voltage V2 corresponds to the specific lamp voltage Va. Voltage Vx is fed to non-inverting input of first comparator 112A of PWM 110A and compared with voltage of a sawtooth pulse from pulse generator 111A to give an output $V_{CP1}$. Output $V_{CP1}$ of first comparator 112A and output $V_{CP2}$ second comparator 113A are then gated at OR gate 73A to give voltage which is then inverted through a NOT gate 74 to give a control voltage Vf for turning on and off MOSFET 21 to regulate the lamp wattage $W_{LA}$.

Operation of wattage controller 70A is now discussed with reference to FIGS. 8A to 8D. Until the lamp voltage increases to the specific voltage Va, as indicated in FIG. 1, voltage Vx is defined by voltage $V_{86}$ from differential amplifier 86A will decrease to shorten high level duration of output voltage $V_{CP1}$ of comparator 112A which in turn increases on-duty of the control voltage Vf, thereby turning on MOSFET 21 at an increasing duty ratio for increasing lamp wattage $W_{LA}$ in accordance with the first load characteristic. After the lamp voltage exceeds the specific lamp voltage Va, voltage Vx which is now defined by voltage $V_{80}$ from operational amplifier 81A will increase as the lamp voltage further increases to thereby elongate high level duration of output voltage $V_{CP1}$ of first comparator 112A. Whereby, on-duty of the control voltage Vf is decreased in the direction of limiting the lamp current for controlling the lamp wattage WLA in accordance with the second load characteristic as defined with reference to FIG. 1. That is, by suitably selecting amplification factors at amplifiers 81A and 86A, the lamp wattage $W_{LA}$ can be controlled to be kept at the maximum lamp wattage Wa or to decreases to pass through the cross-hatched area, as indicated in FIG. 1, with the increase of the lamp voltage $V_{LA}$ to maximum allowable lamp voltage Vb. When the lamp voltage reaches to voltage Vb, the operational amplifier 81A operates at the high amplification factor by turning on of transistor 93A of lamp voltage discriminator 90A to give correspondingly increasing voltage $V_{80}$ and therefore Vx, thereby rapidly limiting the lamp current and therefore lamp wattage $W_{LA}$ to cease operating the lamp as soon as the lamp voltage reaches to voltage Vb. When the lamp wattage is controlled to decrease along a line A–B, as indicated in FIG. 1, by suitably selecting amplification factors of amplifiers 80A and 86A, the lamp wattage can be limited to a level after the lamp voltage exceeds voltage Vb to practically cease operating the lamp without utilizing the lamp voltage discriminator 90A.

Figure 9:
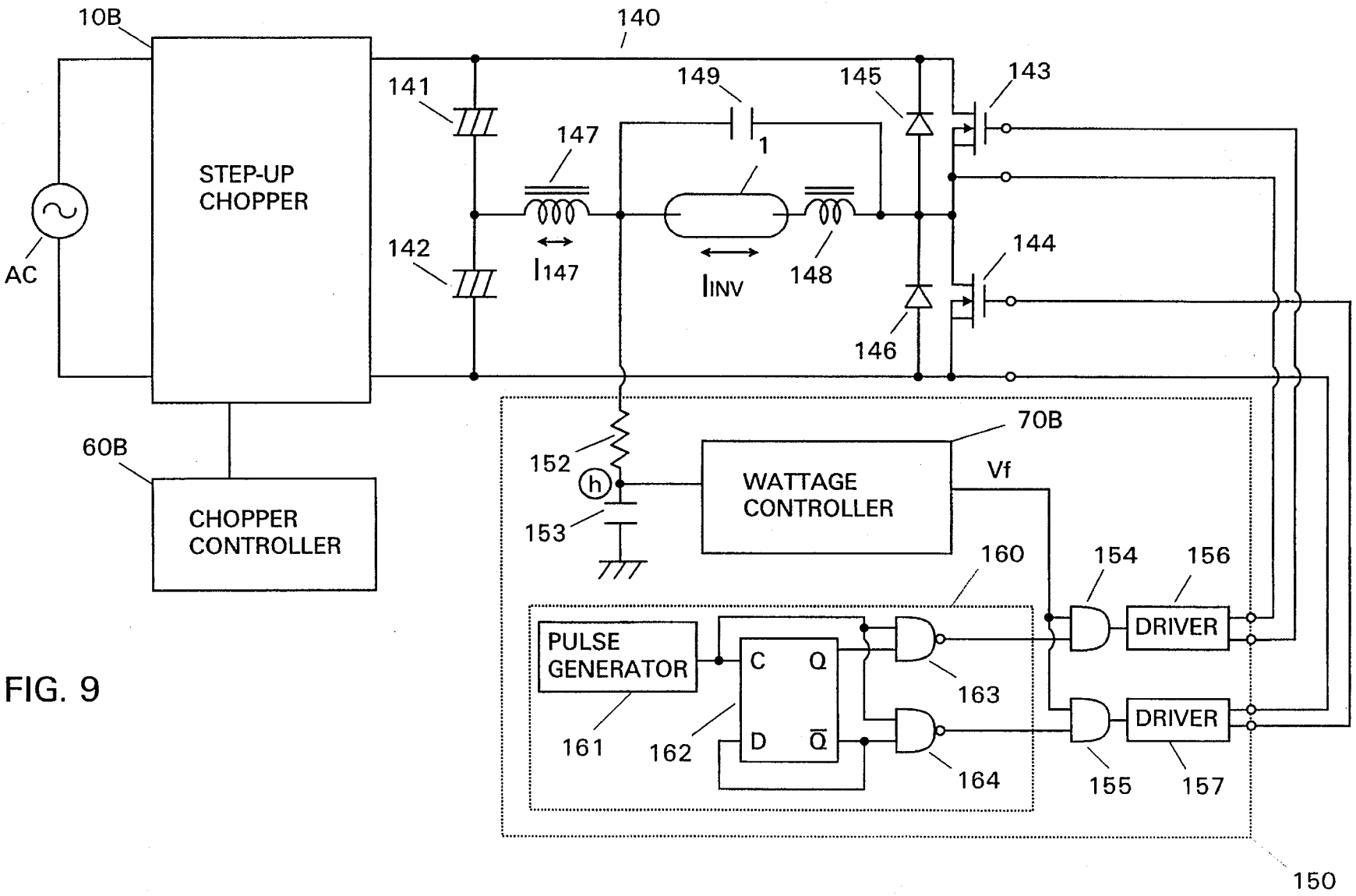
FIG. 9 is a circuit diagram of an electronic ballast utilized for operating the lamp in accordance with a third embodiment of the present invention.

Third Embodiment <FIGS. 9 and 10>

FIG. 9 illustrates an electronic ballast in accordance with a third embodiment of the present invention. The electronic ballast comprises a step-up chopper 10B of the same configuration as utilized in the first embodiment which is controlled by a chopper controller 60B so as to provide a step-up DC voltage from a voltage source AC to an inverter 40B. The inverter 40B comprises a pair of capacitors 141 and 142 connected in series across the output of the step-up chopper 10B so as to be charged thereby. A pair of MOSFETs 143 and 144 is connected in circuit with capacitors 141 and 142 to form therewith half-bridge configuration. Diodes 145 and 146 are connected respectively in anti-parallel with MOSFETs 143 and 144. A discharge lamp 1 is connected in series with inductors 147 and 148 between a connection point of capacitors 141 and 142 and a connection point of MOSFETs 143 and 144. A capacitor 149 is connected in parallel with the series combination of lamp 1 and inductor 148. MOSFETs 143 and 144 are controlled by an inverter controller 150 in such a manner that one of MOSFETs turns on and off repetitively within a fixed cycle where the other MOSFET is turned off, as shown in FIGS. 10A and 10B, in order to apply an AC voltage of rectangular waveform to lamp 1. During one cycle where MOSFET 143 repeats turned on and off while MOSFET 144 is kept turned off, capacitor 1 41 discharges, in response to MOSFET 143 being turned on, to flow a current through a closed loop from capacitor 141, MOSFET 143, inductor 148, lamp 1, and inductor 147 while storing corresponding energy in inductor 147. When MOSFET 143 is turned off, energy is released from inductor 147 to flow a continuing current through a closed loop from inductor 147, capacitor 142, diode 146, inductor 148, and lamp 1. In the subsequent cycle where MOSFET 144 repeats turned on and off while MOSFET 143 is kept turned off, capacitor 142 discharges, in response to MOSFET 144 being turned on, to flow a current through a closed loop from capacitor 142, inductor 147, lamp 1, inductor 148, and MOSFET 144 while storing corresponding energy in inductor 147. When MOSFET 144 is turned off, energy is released from inductor 147 to flow a continuing current through a closed loop from inductor 147, lamp 1, inductor 148, diode 145, and capacitor 141. In this manner, inductor 147 sees a current $I_{147}$ of waveform as shown in FIG. 10C, in response to turning on and off of MOSFETs 143 and 144, which current 147 is then removed of high frequency component by combination of inductor 148 and capacitor 149 to provide an inverter current $I_{INV}$ of rectangular waveform, as shown in FIG. 10D, for operating the lamp 1.

The inverter controller 150 includes an integrator 151 composed of a resistor 152 and a capacitor 153 which is connected in series to connection point between lamp 1 and inductor 147 so as to provide across capacitor 153 a detected voltage indicative of the lamp voltage applied to lamp 1. Thus detected voltage is fed to a wattage controller 70B which is of identical configuration to controller 70A utilized in the second embodiment of FIG. 7 so as to give an high frequency output voltage Vf with varying duty ratio in correspondence to the detected lamp voltage, as explained with reference of FIGS. 8A to 8D in the second embodiment. Included in the inverter controller 150 is a low frequency PWM 160 composed of a pulse generator 1 61 providing a low frequency pulse, a flip-flop 162, and a pair of NAND gates 163 and 164 which are alternately enabled to provide the low frequency pulse of approximately 50% duty ratio, respectively. The resulting low frequency output voltages from NAND gates 163 and 164 are fed respectively to AND gates 154 and 155 where they are ANDed with output voltage Vf from wattage controller 70B to provide control signals through individual drivers 156 and 157 for turning on and off MOSFETs 143 and 144. That is, during enabled duration of either of MOSFETs 143 and 144 determined by the high-level period of the low frequency pulse from PWM 160, the duty ratio of MOSFET is controlled to vary in response to the detected lamp voltage $V_{LA}$ in order to vary lamp current, i.e., lamp wattage $W_{LA}$ in accordance with the load characteristic in the same manner as explained in the second embodiment.

Figure 11:
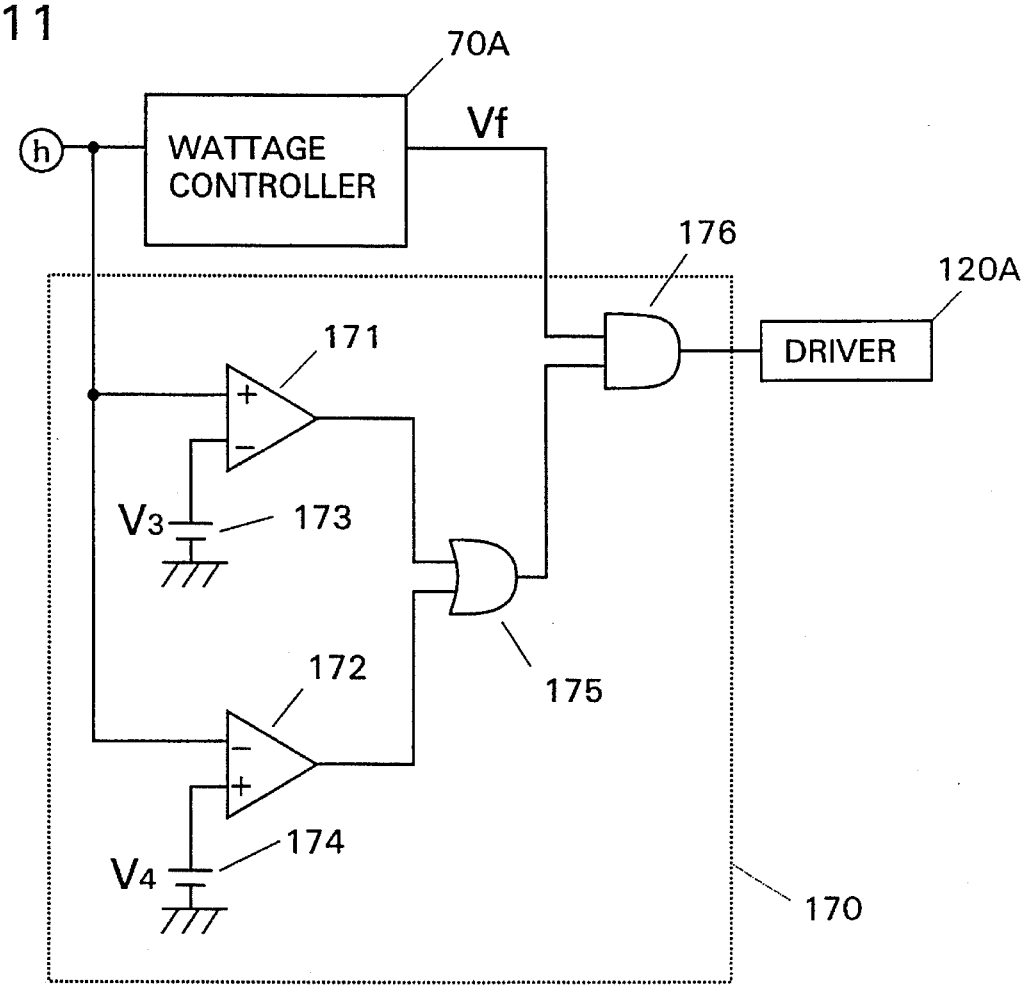
FIG. 11 is a circuit diagram of a lamp extinguisher which may be added to the ballast of the second embodiment.
Figure 12A:
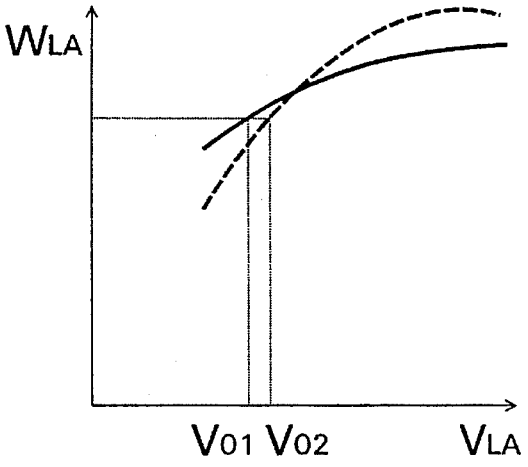
FIG. 12A is a graph of lamp wattage versus lamp voltage in which a solid line indicates load characteristic for the lamp operated by the electronic ballast and a dotted line indicates load characteristic for the lamp operated by a conventional ballast, respectively.
Figure 12B:
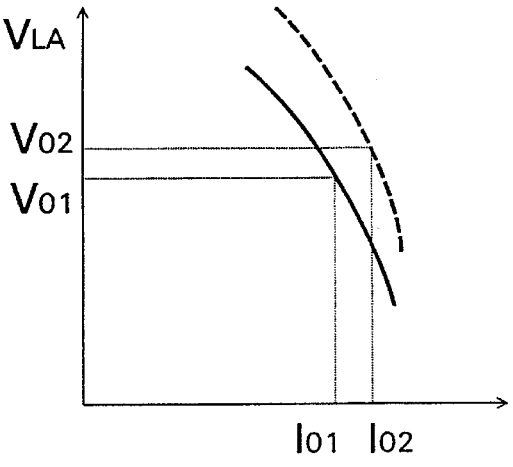
FIG. 12B is a graph of lamp voltage versus lamp current in which a solid line indicates load characteristic for the lamp operated by the electronic ballast and a dotted line indicates load characteristic for the lamp operated by a conventional ballast, respectively.
Figure 13:
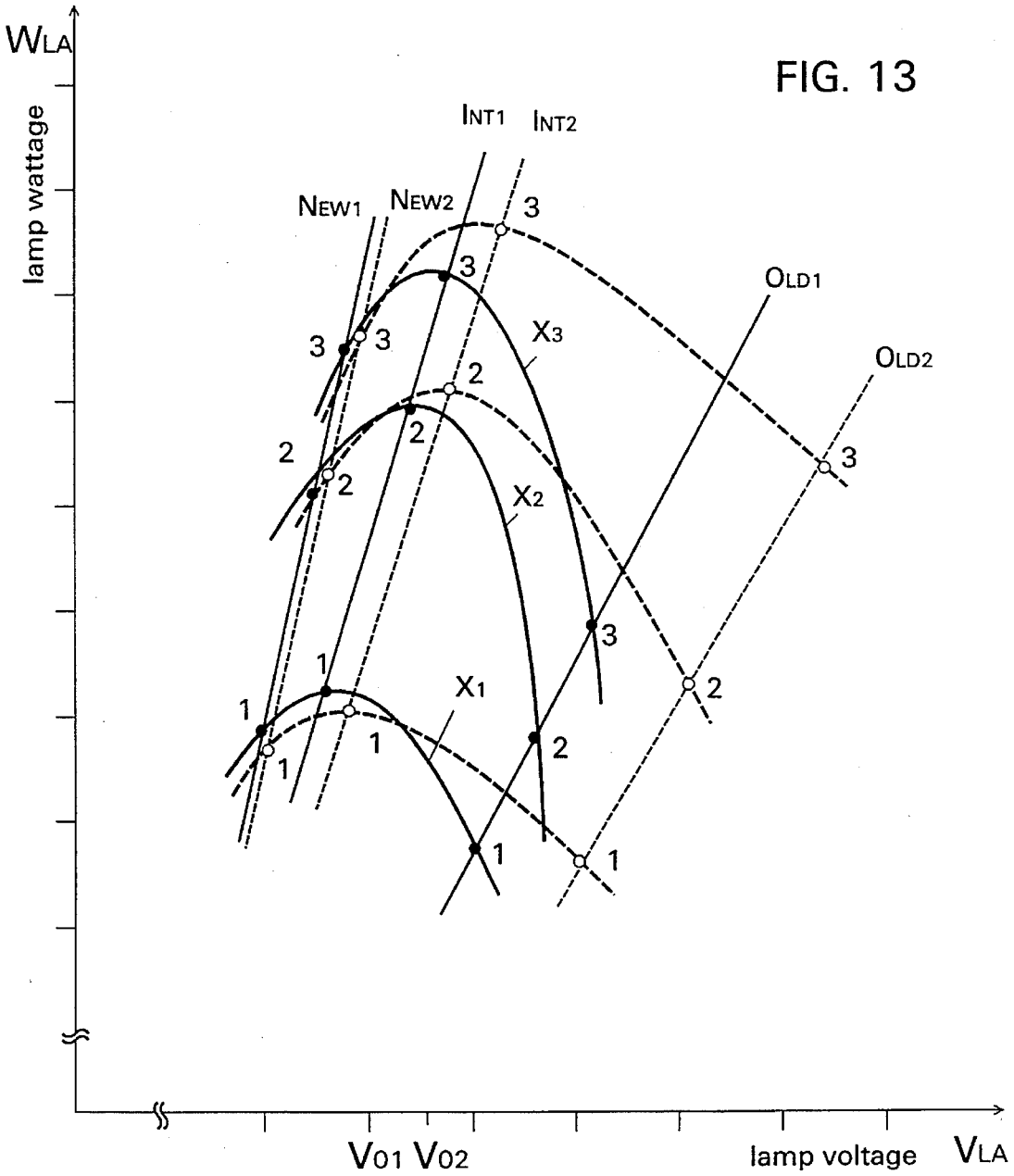
FIG. 13 is a graph of lamp wattage versus lamp voltage indicating several curves indicating arc luminescence of three different levels for three lamps of different operating lamp voltages, in which solid lines represent lamp characteristics for the lamps operated by the electronic ballast, and dotted lines represent lamp characteristic for the lamps operated by the conventional ballast.

FIG. 11 illustrates a compulsory lamp extinguisher 170 which may be utilized in combination with the wattage controller 70A of the second embodiment so as to stop operating the lamp after the lamp is deteriorated to otherwise give excessive arc luminescence and therefore result in dangerous breakage of the lamp. The extinguisher 170 comprises a pair of first and second comparators 171 and 172 of which outputs are gated through an OR gate 175 to provide a control signal to an AND gate 176. First comparator 171 compares the detected voltage indicative of the lamp voltage fed at its non-inverting input with a first reference voltage $V_3$ defined by voltage source 173 connected to an inverting input of comparator 171. Second comparator compares the same detected voltage fed to its inverting input with a second reference voltage $V_4$ defined by voltage source 174 connected to a non-inverting input of comparator 172. Reference voltage $V_3$ is selected to correspond to a secondary voltage that the inverter gives under no load condition, while reference voltage $V_4$ is selected to corresponds to maximum operable lamp voltage Vb, as indicated in FIG. 1. Consequently, when the lamp is deteriorated after an extended use to require the lamp voltage which is greater than voltage Vb and at the same time when the detected voltage is less than the secondary voltage, OR gate 175 provides a low level output to disable the control voltage Vf from passing through AND gate, thereby cease operating the inverter. Otherwise, the control voltage Vf is allowed to be fed through driver 120A to turn on and off corresponding MOSFETs for operating the inverter in a controlled manner to vary the lamp wattage $W_{LA}$ in accordance with the load characteristic as explained hereinbefore.

What is claimed is:

1. A method of operating a high pressure gas discharge lamp with an electronic ballast having a lamp power factor of substantially 1.0, said discharge lamp having a rated lamp voltage and exhibiting an increasing lamp voltage throughout expected lamp life, said method comprising the steps of:

obtaining a lamp equi-luminescence performance curve X along which a lamp voltage and a lamp wattage vary in such a manner as to keep arc luminescence of an arc developing between electrodes of the lamp at substantially constant level, said arc luminescence being defined to be a maximum luminescence of the arc having varying luminescence along the length of said arc, said constant level being determined to be the luminescence that the lamp gives when operated by said electronic ballast at said rated lamp voltage;

analyzing said lamp performance curve X to determine a specific lamp voltage Va at which said performance curve X gives a maximum lamp wattage Wa;

operating said lamp in accordance with a first load characteristic for controlling and increasing said lamp wattage, substantially along said lamp performance curve X, until the lamp voltage increases to said specific lamp voltage Va; and operating said lamp, after said lamp voltage increases beyond said specific lamp voltage Va, in accordance with a second load characteristic for controlling and keeping said lamp wattage above the lamp performance curve X, but not exceeding said maximum lamp wattage Wa, and for keeping said arc luminescence below a predetermined limit level.

2. The method as set forth in claim 1, wherein said step of operating said lamp includes the step of keeping said arc luminescence below said predetermined limit level of the arc luminescence in which the lamp deteriorated to have a maximum operating lamp voltage Vb just before the end of the lamp life gives when operated by an inductive ballast having the lamp power factor of at most 0.9.

3. The method as set forth in claim 1, wherein said step of operating said lamp in accordance with said second load characteristic includes the step of operating said lamp at said second load characteristic which is represented by a characteristic line having a negative gradient of said lamp wattage with respect to the increasing lamp voltage and extending from a point of said maximum lamp wattage Wa at said specific lamp voltage Va to a point of the lamp wattage at an operating voltage on another lamp performance curve, said operating voltage being required to operate a near-end-of-life discharge lamp by an inductive ballast having the lamp power factor of at most 0.9, said near-end-of-life discharge lamp exhibiting such a high lamp voltage for causing extinction when operated by said inductive ballast, said another lamp performance Y being obtained to give a varying lamp wattage with respect to the lamp voltage by operating said electronic ballast while maintaining a fixed arc luminescence that said near-end-of-life lamp shows at said operating voltage when operated by said inductive ballast.

4. The method as set forth in claim 2, wherein said step of operating said lamp in accordance with said second characteristic includes the step of operating said lamp at said second load characteristic which causes said lamp to turn off when said lamp voltage increases up to an operating voltage which is required to operate a near-end-of-life discharge lamp by said inductive ballast having the lamp power factor of at most 0.9, said near-end-of-life discharge lamp exhibiting such a high lamp voltage for causing extinction when operated by said conventional inductive ballast.

5. The method as set forth in claim 1, wherein said step of obtaining said lamp equi-luminescence performance curve X for keeping said arc luminescence of said arc at said substantially constant level includes the step of providing an electronic ballast which is comprised of an AC-to-DC converter providing a DC current from an AC voltage source, an inverter receiving the DC current from said AC-to-DC converter to provide an AC voltage to operate said lamp, and a wattage controller, said wattage controller detecting the lamp voltage and controlling to vary the lamp wattage in response to the varying detected lamp voltage in accordance with said first and second load characteristics.

6. The method as set forth in claim 5, wherein said step of providing said electronic ballast includes the step of providing an electronic ballast having said inverter which provides a high frequency AC voltage for operating the lamp.

7. The method as set forth in claim 1, wherein said step of obtaining said lamp equi-luminescence performance curve X for keeping said arc luminescence of said arc at said substantially constant level includes the step of providing an electronic ballast which is comprised of:

an AC-to-DC converter for providing a DC voltage from an AC voltage source, a step-down chopper which receives said DC voltage to give a limited DC current, a filter for smoothing said DC current from said step-down chopper to give a smoothed DC current, an inverter which receives said smoothed DC current to provide a low frequency rectangular waveform AC voltage for operating said lamp; and a chopper controller for controlling said step-down chopper, wherein said step-down chopper includes switching means for interrupting said DC voltage to give said limited DC current, and wherein said chopper controller includes a wattage controller and means for detecting the lamp voltage being applied to said lamp, said wattage controller varying duty ratio of said switching means in response to the varying detected lamp voltage so as to vary the lamp wattage in accordance with said first and second load characteristics.

* * * * *